US006079420A

United States Patent [19]

Musum

[11] Patent Number: 6,079,420

[45] **Date of Patent: *Jun. 27, 2000**

[54] HIGHLIGHTING COMB

[75] Inventor: Veny W. Musum, Basking Ridge, N.J.

[73] Assignee: Infinite Concepts, LLC, New York, N.Y.

[ * ] Notice: This patent is subject to a terminal disclaimer.

[21] Appl. No.: 09/245,127

[22] Filed: Jan. 29, 1999

Related U.S. Application Data

[63] Continuation of application No. 08/976,804, Nov. 24, 1997, Pat. No. 5,947,130.

[60] Provisional application No. 60/046,253, May 12, 1997.

[51] Int. Cl.[7] ..... A45D 24/22

[52] U.S. Cl. ..... 132/125; 132/150; 132/270; 132/901

[58] Field of Search ..... 132/109, 110, 132/116, 125, 144, 150, 157, 158, 161, 270, 901

[56] References Cited

U.S. PATENT DOCUMENTS

| | | | |
|---|---|---|---|
| 541,317 | 6/1895 | Cushing . | |
| 1,436,776 | 11/1922 | Nach . | |
| 1,671,094 | 5/1928 | Widdows . | |
| 1,958,802 | 5/1934 | Seaman . | |
| 2,028,588 | 1/1936 | Carson . | |
| 2,249,267 | 7/1941 | Berry | 132/109 |
| 2,264,346 | 12/1941 | Tupper . | |
| 2,384,152 | 9/1945 | Black . | |
| 2,610,637 | 9/1952 | Fuentes . | |
| 3,463,170 | 8/1969 | McCullough . | |
| 3,477,447 | 11/1969 | Eldredge . | |
| 4,213,423 | 7/1980 | Bryan et al. . | |
| 4,345,608 | 8/1982 | Cavaioli et al. | 132/160 |
| 4,495,958 | 1/1985 | Roeder . | |
| 4,566,472 | 1/1986 | Mueller et al. . | |
| 4,605,020 | 8/1986 | Lavoie . | |
| 4,815,484 | 3/1989 | Steventson . | |
| 4,993,438 | 2/1991 | Hunt . | |
| 5,188,132 | 2/1993 | Barkus . | |
| 5,215,106 | 6/1993 | Choi . | |
| 5,533,537 | 7/1996 | Mourad . | |

FOREIGN PATENT DOCUMENTS

| | | |
|---|---|---|
| 219764 | 2/1962 | Austria . |
| 806990 | 3/1952 | Germany . |

OTHER PUBLICATIONS

White comb with Attachment—This Comb has the following indicia on its handle: Pat. No. 96310, at least one year prior to Nov. 24, 1997.

"The Perfect Hair Weaver"—black comb with a tapering handle, at least one year prior to Nov. 24, 1997.

"Karolight by Karol Fisher"—light blue comb, at least one year prior to Nov. 24, 1997.

"Clairol Nuances—Glide Applicator—" translucent eight tong pick, at least one year prior to Nov. 24, 1997.

"Original Pump Comb"—white comb with translucent handle, at least one year prior to Nov. 24, 1997.

*Primary Examiner*—Todd E. Manahan

*Attorney, Agent, or Firm*—Lerner, David, Littenberg, Krumholz & Mentlik, LLP

[57] ABSTRACT

A comb for treating hair which is simple to use effectively by either a professional hair stylist or a non-professional. The comb includes tines, the free ends extending to form an arcuate plane, and forwardly deepening retaining areas between adjacent tines for retaining treatment material, such as highlighting gel. The comb also includes pairs of forked teeth at the free ends of the tines. Each pair of teeth define a recessed groove therebetween which tapers back from the top surface to the bottom surface of the tines. Connected to these grooves are channels which extends along the bottom surface substantially toward the spine of the comb to guide the hair not being treated away from the retaining area. In use, the comb is swiped through the hair, the hair is channeled between the tines so that the hair receives treatment material which has been previously charged in the retaining areas.

15 Claims, 2 Drawing Sheets

20
22
23
24
25
26
27
28
29
30
32
34
40
48
1
2
3
4
5
6
7
8
9

4
4
28
30
46
48
32
40
52
48
46

22
28
36
53
38
42
44
52
40
50

23
24
25
26
28
40
44
44

26
38
38
40
52
53
53
53

24
28
36
40
42
42
44
46
50
52

28
28
52

HIGHLIGHTING COMB

CROSS REFERENCE

This application is a continuation and claims the benefit of commonly assigned U.S. patent application Ser. No. 08/976,804, filed Nov. 24, 1997, now U.S. Pat. No. 5,947,130 which claims the benefit of U.S. Provisional Application Ser. No. 60/046,253, filed May 12, 1997, the disclosures of which are incorporated by reference herein.

BACKGROUND OF THE INVENTION

The present invention is directed to a hair treatment device, and more specifically, to a hair coloring or highlighting comb.

Many people desire to treat their hair with various types of treatment materials. By way of example only, treatment materials include, but are not limited to, bleaches, peroxides, lye, coloring dyes, highlighting liquids and gels as well as ointments, oils, shampoos, conditioners and the like. For purposes of the discussion herein, the term "treatment" is to be understood as a broad term which encompasses all of the above and other types of materials and especially coloring and/or highlighting.

Several different methods or applications are used for treating hair, both professionally and by home application. If a person desires to have blonde highlights, for example, he or she can either have his or her hair treated by a professional at a beauty salon or treat his or her hair himself or herself. Many people opt to have their hair treated by a professional because of the difficulties in applying treatment material in a way that achieves a desired look for that person. Several treatment methods or processes are available from a professional. It should be appreciated that these methods may be performed by non-professionals as well.

One treatment method involves placing a cap on a person's head. The cap includes a plurality of tiny openings. A professional ideally pulls selected pieces of the person's hair through these openings. Then, the professional treats these portions of the person's hair accordingly. This method is expensive and time consuming. Also, the desired results may not be achieved. For example, the person's roots may not receive treatment, making the resulting application appear unprofessional for most people. One reason for this is that it is difficult to treat hair close to the scalp using this method. As a result, shortly after a person receives a hair treatment application, one can readily observe the untreated roots. This process also is undesirable because, when using a cap, it is difficult to prevent overlap coloring. Overlap coloring occurs when a person receives a subsequent treatment and the same portions of the hair are inadvertently retreated, potentially causing chemical damage to the hair.

In another process, a professional first selects a portion of a person's hair. The professional then weaves out separate pieces of the selected portion of hair so that intermittent strands of hair will be available for treating. The professional isolates these pieces from the rest of the hair by placing a piece of foil underneath them. The professional then swipes treatment material onto the selected hair, using an applicator brush or the like. Finally, the professional wraps the hair with the foil so that the hair may be treated with the treatment material. The professional then repeats the above steps on other pieces of selected hair to achieve a desired treated effect. This method is messy, very time consuming, costly and sometimes inaccurate both in not reaching all the way to the scalp, as well as, not treating the correct portions of the person's hair to achieve the desired appearance. Overlap coloring may also occur during this process, which, as mentioned above, is undesirable.

Another process for treating a person's hair is through the use of a treatment comb. Known treatment combs are usually used by professionals since a certain degree of skill and/or dexterity is needed to use them. However, non-professionals do attempt to utilize treatment combs at home, albeit with mostly disastrous results. It is known to use combs for treating, and particularly coloring or highlighting, hair. Treatment combs, such as, for example, highlighting combs, seek to selectively highlight portions of a person's hair by combing material through those selected portions. In essence, the tines of the comb retain hair treatment material to be applied to the hair. A professional loads the treatment material onto the comb, either with a squeeze bottle or an applicator brush and then swipes the comb through a person's hair.

Certain combs are available which have been used specifically for highlighting hair. One comprises a comb system having multiple parts needing manipulation during a highlighting application. Other combs have insufficiently sized tines, which make it difficult to highlight longer hair (i.e., shoulder length or longer) because the tines do not hold enough treatment material.

Prior combs have an additional disadvantage of misconstructed reservoir or treatment retaining areas. For example, known combs have reservoirs which are deeper at the back of the teeth i.e., toward the spine. This limits the amount of treating material available in the correct areas of the comb to complete the desired length of a person's hair. In addition, existing combs often snag as they are swiped through the hair. This snagging may contribute to a botched highlighting application, which may result in a time-consuming re-application. Worse yet, the person may have to wait until their hair grows out before attempting another application. These shortcomings with presently known combs result in dissatisfied users who may need the highlighting application performed over again, or worse yet, may need major and expensive corrective hair color or highlighting procedures performed for them.

As an alternative to a comb, there is a fork-like or "glider" applicator available from Clairol Inc. of Stamford, Conn. The applicator is known as the NUANCES GLIDER applicator and includes eight solid fingers or protrusions extending in a random, multiple prong, fork-like manner. The applicator is dipped into treatment solution and indiscriminately stroked through a person's hair. With this type of applicator, it is difficult to achieve a consistent treatment throughout the hair, because there is no way to segment the portions of hair in a systematic manner.

Thus, there is a need for a comb that can provide treatment to all desired portions of a person's hair. There also is a need for a treatment comb which is constructed to reduce snagging of the hair during use. Further, there is a need for a comb having a construction which provides for treatment of substantially long hair from the roots to the ends. Further, there is a need for a comb which completes a treatment application in less time, with fewer overall swipes through the hair, providing for fewer opportunities for error.

SUMMARY OF THE INVENTION

In accordance with one aspect of the present invention, there is provided a highlighting comb, comprising a spine having a first end and a second end and a plurality of spaced-apart tines, arranged side-by-side between the first and second ends of the spine. Each of the tines has a spine end attached to the spine, and a forwardly extending free end remote from the spine. Also, each of the tines has a top surface, a bottom surface, and side walls extending between the top and bottom surfaces. Opposing side walls of adjacent tines are constructed to define a forwardly deepening retaining area in the space between the tines which extends lengthwise between the spine and free ends of the respective tines. Also, the retaining area is adapted to retain hair treatment material at least partially by surface tension. The retaining area is open adjacent the top and bottom surfaces of the tines so as to be adapted to receive hair for treatment.

Preferably, the retaining area extends substantially from adjacent the spine end to adjacent the free end of the tines.

More preferably, the retaining area has a first retaining end and a second retaining end. Opposing side walls of adjacent tines comprise opposing ledges extending therefrom to facilitate retention of hair treatment material within the treatment material retaining area. The ledges preferably extend from the first retaining end to the second retaining end of the retaining area.

Most preferably, the first retaining end of the retaining area extends to the spine end of the tines and the second retaining end of the retaining area extends to the free end of the tines.

Desirably, the highlighting comb includes a handle attached to the second end of the spine. Preferably, the handle converges to a point. The pointed handle may be used during the highlighting application to separate or weave out selected portions of hair for treatment.

Preferably, the tines vary in length and are constructed such that the free ends of the tines form an arcuate plane. Desirably, the arcuate plane has a center of curvature where the arcuate plane is between the center of curvature and the free ends of the tines.

Most preferably, the spine bows from the first end to the second end of the spine to facilitate the comb to the contour of a person's head.

Most desirably, the highlighting comb further comprises flow barriers associated with the retaining areas for preventing the excess flow of hair treatment material toward the spine. In a preferred embodiment, the top surface includes indicia for facilitating various process steps. More preferably, the indicia is disposed on the flow barriers. Most preferably, the indicia includes numbers or other symbols such as letters of the alphabet.

In a most preferred embodiment, the free ends of the tines further comprise a pair of spaced-apart teeth. The teeth define a recessed groove therebetween. The recessed groove is adapted to receive hair which is not to be treated by hair treatment material. Desirably, each bottom surface of the tines further define a channel, connected to the respective recessed groove for guiding hair received by the recessed grooves along each bottom surface.

In accordance with another aspect of the present invention, there is provided a highlighting comb, comprising a spine having a first end and a second end and a plurality of spaced-apart tines arranged side-by-side between the first and second ends of the spine. Each of the tines has a spine end attached to the spine and a forwardly extending free end remote from the spine. Also, each of the tines has a top surface, a bottom surface, and side walls extending between the top and bottom surfaces. Opposing side walls of adjacent tines are constructed to define a retaining area in the space between the tines which extends lengthwise between the spine and free ends of the respective tines. The retaining area is adapted to retain hair treatment material at least partially by surface tension and the retaining area is open adjacent the top and bottom surfaces of the tines so as to be adapted to receive hair for treatment. In addition, the free end of the tines terminate with a pair of spaced-apart teeth. The teeth define a recessed groove therebetween which is sized to receive hair not to be treated by hair treatment material. Also, each of the bottom surfaces of the tines define a channel. Each channel is connected to the respective recessed groove and extends along each bottom surface from the free end substantially to the spine end of the tines. Preferably, the recessed groove between the teeth tapers back from the top surface to the bottom surface.

Desirably, the retaining area of this aspect of the present invention is forwardly deepening between the spine and free ends of the respective tines and more preferably, the retaining area extends from adjacent the spine end to adjacent the free end of the tines.

Desirably, the teeth include a concave portion for facilitating the movement of hair through the highlighting comb.

In accordance with yet another aspect of the present invention, there is provided a highlighting comb, comprising a spine having a first end and a second end and a plurality of spaced-apart tines arranged side-by-side between the first and second ends of the spine. Each of the tines has a spine end attached to the spine and a forwardly extending free end remote from the spine. Each of the tines has a top surface, a bottom surface and side walls extending between the top and bottom surfaces. Opposing side walls of adjacent tines are constructed to define a retaining area in the space between said tines which extends lengthwise between the spine and free ends of the respective tines. The retaining area is adapted to retain hair treatment material at least partially by surface tension and the retaining area is open adjacent the top and bottom surfaces so as to be adapted to receive hair for treatment. Also, the spine is bowed from the first end to the second end of the spine.

Preferably, the tines, in this aspect, vary in length and are constructed such that the free ends of the tines form an arcuate plane.

BRIEF DESCRIPTION OF THE DRAWINGS

The above and other features, aspects and advantages of the present invention will become apparent, as will a better understanding of the concepts underlying the present invention, by reference to the description which follows and refers to the accompanying drawings in which.

DETAILED DESCRIPTION OF THE PREFERRED EMBODIMENT

The present invention is directed to a hair treatment comb (e.g., coloring and/or highlighting), which may be used advantageously by a professional hair stylist and also by a non-professional as well. It is to be understood that the present invention covers a comb which provides for treatment of a person's hair in substantially less time than known methods. The present invention also covers an economical comb with substantially improved accuracy over other treating methods including those methods which utilize combs. Also, it is to be understood that the scope of the present invention includes a comb which may be used to apply medicine, shampoo, conditioner, coloring, bleach, lye, peroxide, highlighting gel, and any other type of hair treatment material, to a person's hair. By way of example only, the following discussion concentrates on the comb of the present invention as used for highlighting hair.

Figure 1:
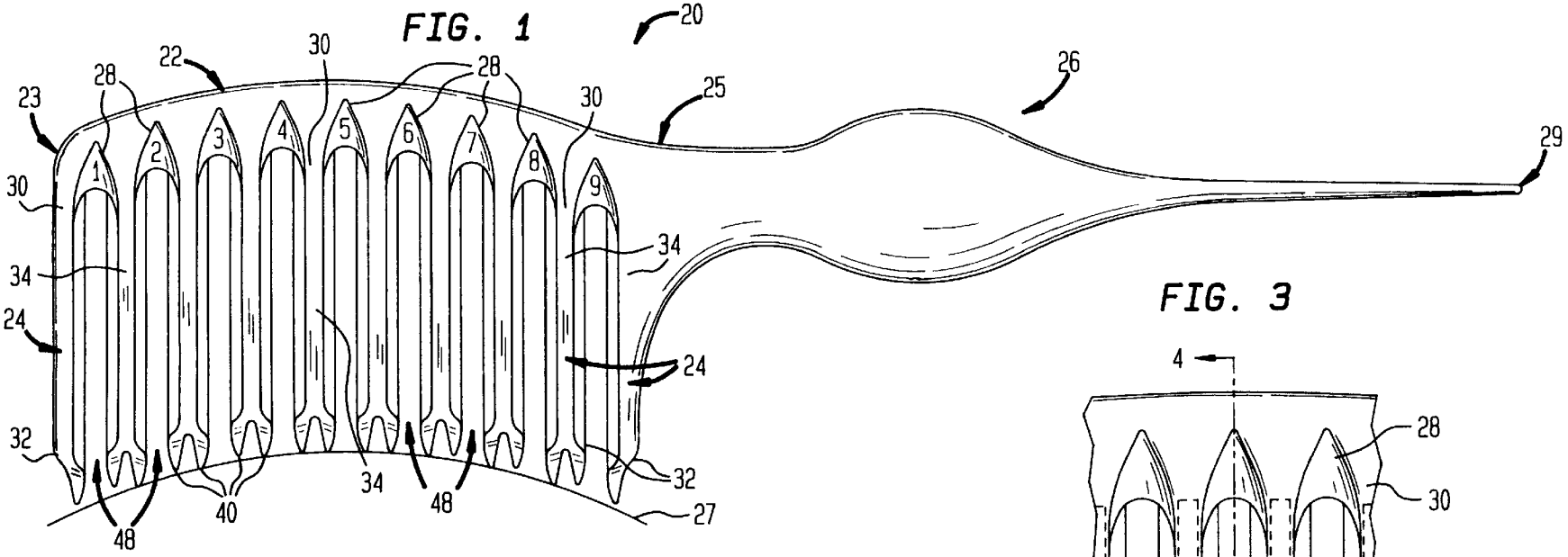
FIG. 1 is a top plan view of a comb in accordance with one embodiment of the present invention.

In accordance with one aspect of the present invention, as shown in FIG. 1, there is provided a highlighting comb generally designated as 20. The highlighting comb 20 comprises a spine 22, a plurality of tines 24 and a handle 26.

Figure 2:
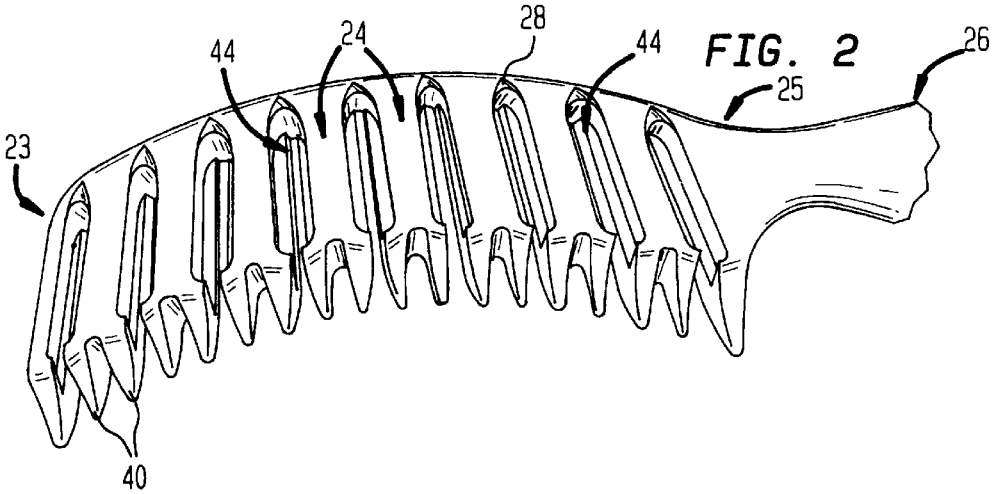
FIG. 2 is a front perspective view of the comb of FIG. 1, highlighting the bow in the comb.

Referring to FIG. 2, the comb 20 is preferably bowed from the first end 23 to the second end 25 of the spine 22 so that when a user places the comb 20 on a person's head and swipes the comb 20 through a person's hair, the tines 24 generally follow the contour of the person's head, and thus are situated close to the scalp.

Figure 5:
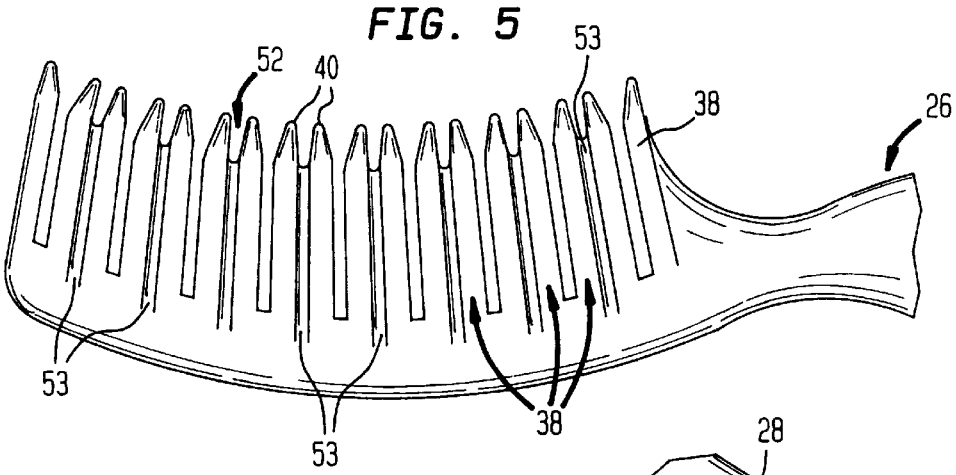
FIG. 5 is a bottom perspective view of the comb of FIG. 1, showing grooves between the teeth and the bottom surface channels connected to the grooves and extending toward the spine of the comb.

As shown in FIGS. 1, 2 and 5, the tines 24 collectively have lengths such that the ends of the tines form an arcuate plane 27. This arcuate plane 27 shape facilitates application of the highlighting material as close to the scalp as possible for the length of the spine 22.

The combination of the arcuate plane 27 and the bowed spine 22 provides for an even closer application of the comb 10 to a person's scalp. This results in treatment very close to the scalp so, for example, the roots may be treated as well. Preferably, this closeness provides for treatment of the roots as close as at least about one-sixteenth (1/16) of an inch from the scalp. This closeness is somewhat important in most applications, and especially when highlighting, in order to create a desired effect. In general, the desired highlighting effect for most people is a look which makes it appear that the person has naturally occurring highlights. It is to be appreciated that certain people prefer to expose their untreated (or in this case, unghighlighted) roots or other portions of their hair. This desired effect is also is contemplated by the present invention.

The handle 26 is attached to the second end 25 of the spine 22. In a preferred embodiment, the handle extends out and converges to a point 29. The point 29 is constructed to facilitate the sectioning or portioning of hair pieces during an application. The handle 26 in this preferred embodiment is solid. However, it should be appreciated that the handle may comprise a housing constructed to define a hollow storage compartment (not shown) for storing treatment material, such as, by way of example only, highlighting gel, before it is supplied to the tines 24. The handle 26 also may include a means for transporting the treatment material from the handle to the tines 24 such as by squeezing the handle 26 and thus forcing the treatment material from the storage compartment and into the treatment material retaining area 44 (discussed below).

Figure 4:
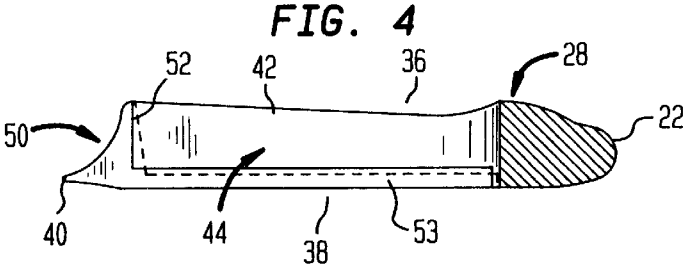
FIG. 4 is a section taken along line 4—4 in FIG. 3, showing an enlarged side elevation view of one of the tines of the comb of FIG. 1, including the forwardly deepening retaining area.

Another important aspect of the present invention is its tines 24, which are described in detail presently. Each tine 24 comprises a spine end 30 attached to the spine 22 and a free end 32 remote from the spine 22. The tines 24 further include a top surface 36 and a bottom surface 38 (see FIGS. 4 and 5). Walls 42 extend from the top surface 36 to the bottom surface 38. Each tine 24 is constructed so as to create a blocking portion 34 which is formed by the top surface 36 and the walls 42. Collectively, these blocking portions 34 substantially prevent treatment material from remaining on the top surface 36 after the material has been applied to the comb 20. That is, the blocking portions 34 facilitate the migration of treatment material into the treatment material retaining area 44 (discussed below) which is between the tines 24.

Adjacent tines have opposing walls 42 which, together with the top surfaces 36 and the bottom surfaces 38, are constructed to define a retaining area 44. Preferably, this retaining area 44 is forwardly deepening from the spine end 30 to the free end 32. In this preferred embodiment, the forwardly deepening characteristic is achieved by providing higher portions of the walls 42 at the free end 32. Since the retaining area 44 is forwardly deepening, it allows for more treatment material, such as highlighting gel, to be retained at the free end 32 of the tines 24. This free end 32 generally contacts the hair first as the treatment material is being dispensed. Having more treatment material at this free end thus facilitates treatment of the hair close to the scalp and allows for treatment of most desired lengths of hair including hair at least shoulder length and somewhat longer. Preferably, one charge of treatment material to the tines may treat hair as long as about twenty inches (20").

The opposing walls 42 may be vertical from the top surface 36 to the bottom surface 38. As an alternative, the walls may taper inwardly to define a wedged-shaped retaining area (not shown). Any other suitable arrangement is contemplated which provides an opening, gap or slot to allow hair to be treated to flow through it while also providing for a retaining area which is capable of retaining treatment material, such as gel. In a preferred embodiment, the treatment material or gel is retained at least partially by surface tension. That is, because there is a gap, or other type opening, within the retaining area 44, the treatment material has to be capable of being at least temporarily suspended within the retaining area by its own attractive forces, i.e., surface tension.

Also illustrated in this preferred embodiment of the comb 20 are ledges 46 between adjacent tines 24. The ledges 46 may extend from respective opposing walls 42, and may be generally coplanar. The ledges 46 define slots 48 for receiving portions of the hair being highlighted. Preferably, the ledges 46 extend from the one end of the retaining area to the other end of the retaining area, as shown in the figures. However, it is to be understood that these ledges may be constructed in the center portions of the retaining areas or may only extend from one end of the retaining area or the other.

The illustrated retaining area 44 extends substantially from the spine 22 to the free end 32 of the tines 24. However, in an alternate embodiment, the retaining area 44 need not have such length. For instance, the retaining area 44 may be limited in length to only half the length of the tines 24 beginning at the free end 32 and extending toward the spine 22 or visa versa. It is important for most applications that the retaining area 44 begin as close to the free end 32 as possible to ensure that the roots receive the treatment material when applied. Also, to facilitate a specific type of application, for example, where only a portion of the hair is to be highlighted, the retaining area 44 may be disposed in the middle of the tines or close to the spine 22. Moreover, the retaining areas 44, on a single comb, may be arranged at different locations per each tine 24 from one end of the comb 20 to the other.

The spine 22 preferably comprises flow barriers 28 disposed thereon and associated near the tines 24. The flow barriers 28, in an alternative embodiment, may be disposed anywhere along the tines 24 so long as they reduce or substantially prevent the excess flow of highlighting gel toward the spine. The flow barriers 28 may include indicia for use in performing various process steps. For instance, the flow barriers 28 may be numbered sequentially from one to nine (see FIG. 1) such that when using the comb 20, the user may coordinate the numbers with a particular process being performed. This indicia also may consists of letters of the alphabet, both in sequential order or in some other order which facilitates a particular process such as dyeing only the bangs or having multiple tine-distances between highlighting portions of the hair.

Figure 3:
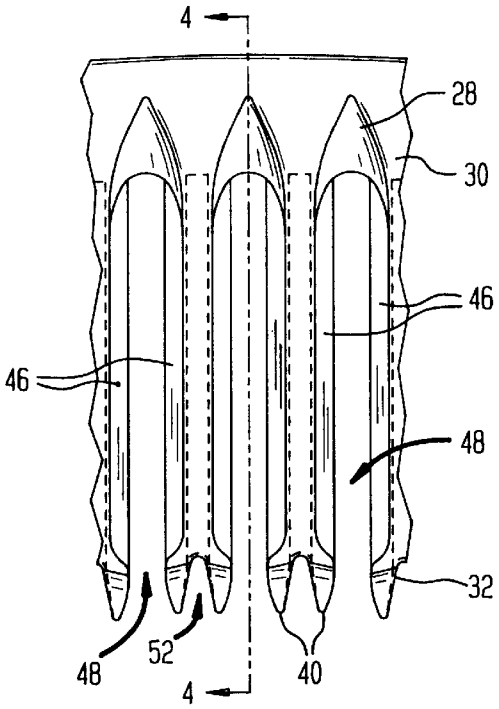
FIG. 3 is an enlarged top plan view of a portion of the comb of FIG. 1.
Figure 6:
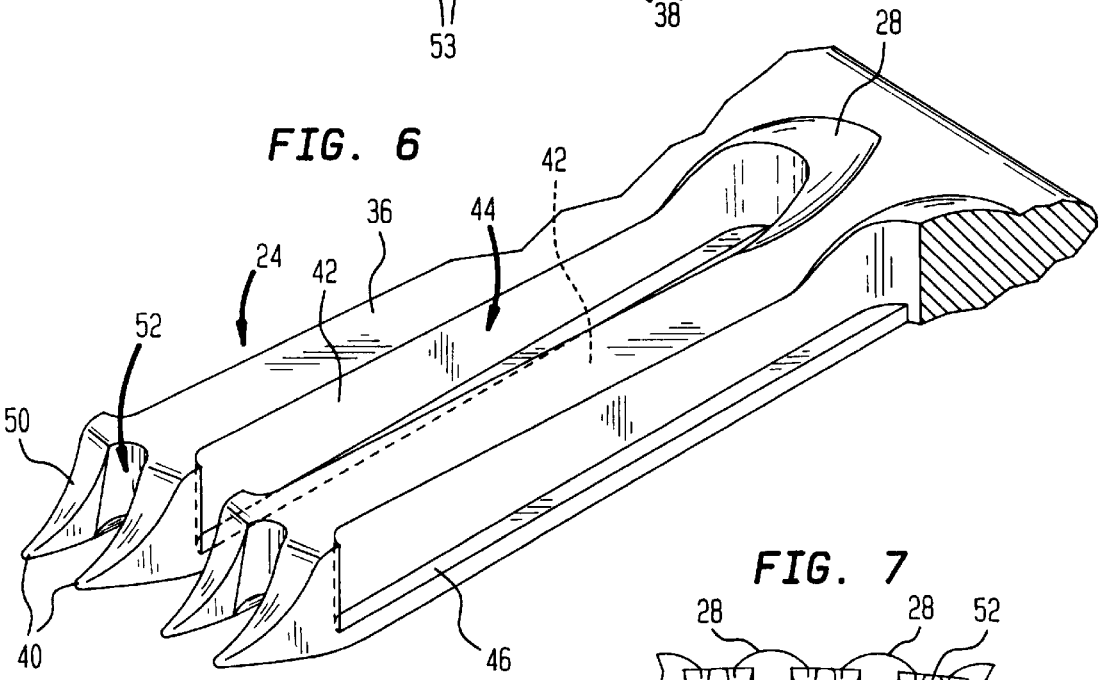
FIG. 6 is an enlarged perspective view of a portion of the tines of the comb of FIG. 1, showing the teeth and reservoir area.
Figure 7:
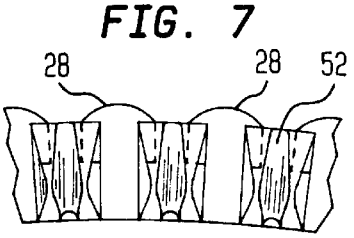
FIG. 7 is an enlarged front elevation view of a portion of the tines of the comb of FIG. 1, showing the tapered recessed groove between the teeth.

The free end 32 of the tines 24 terminate with a pair of forked teeth 40. The teeth 40 are shaped as such to facilitate ease of movement of the comb 20 through the hair during an application. For example, each pair of teeth 40 have a concave or scooped-out portion 50 (see FIGS. 4 and 6). This scooped-out portion provides or facilitates a smooth stroke of the comb 20 through the hair. As best shown in FIGS. 3, 6 and 7, the teeth 40 further define a recessed groove 52 defined therebetween for receiving hair which is not being highlighted. In the preferred embodiment, this recessed groove 52 tapers back from the top surface 36 to the bottom surface 38 of the free end 32 of each tine 24.

As best shown in FIGS. 3 and 5, each recessed groove 52 connects to a channel 53 which runs along the bottom surface 38 of each tine 24 to further facilitate the free movement of the comb 20 through the hair and to mitigate snagging. By way of example, the comb 20 is placed on the person's head and the portion of the hair which is not to be treated, or in this example highlighted, is initially guided into the recessed grooves 52 between the pairs of teeth 40. Then, as the comb is swiped through the hair, the hair within the recessed grooves 52 is further guided or channeled into the channels 53. In a preferred embodiment, as illustrated, the channels 53 extend from the recessed grooves 52 at the free ends 32 toward the spine 22. Other arrangements also are contemplated such as channels which do not extend as far but instead end about halfway between the free end 32 and the spine end 30.

The comb 20 may be made of any type of material capable of withstanding hair treatment materials such as bleaches, dyes, coloring liquids and gels, highlighting liquids and gels, lard, peroxide and the like. Examples of such material include plastic, woods, metal, laminates, composites and the like. Preferably, the comb 20 may be translucent so the user may observe as much as possible of the person's hair being treated during an application. More preferably, the comb is shatter-proof and durable enough to withstand being dropped on occasion.

In a most preferred embodiment, the spine 22 has a length from its first end 23 to its second end 25 of about five inches (5"). The tines 24 range in size with at least one tine measuring about two and three-sixteenth inches (2 3/16"). The height of the walls 42 ranges from about 0.25 inches to about 0.375 inches. In this preferred embodiment, the higher portion of the walls 42 is toward the free end 32. The slots 48 in the retaining areas 44 near the bottom surfaces 38 are about 0.09375 inches in width. It is to be understood that other sizes and dimensions are contemplated and are within the scope of the present invention.

In use, a professional or non-professional holds the comb 20 in a generally horizontal position to apply the treatment material. The user charges the retaining areas 44 between the respective adjacent tines 24 with treatment material (not shown). The treatment material may be charged into the retaining areas 44 by squeezing it from the handle 26 as described above. The retaining area 44 also may be charged through the use of an external squeeze bottle which contains the treatment material. In this type of application, the user squeezes treatment material into each retaining area 44 individually until they are fully charged. As an alternative, and more preferably, the user employs an applicator brush (not shown) which has been loaded with treatment material itself.

The user swipes the brush across the tines 24 of the comb 20 from the first end 23 to the second end 25 of the spine 22 or vice versa until the retaining areas 44 have a sufficient amount of treatment material. It is in this final type of charging method that the blocking portions 34 of the tines 24 are most operative. That is, when the user swipes the applicator brush over the comb 20, the blocking portions 34 of the tines 24 urge the material into the retaining areas 44 and away from the top surfaces 36. This construction provides for a one-piece comb which may be charged with treatment material quickly and with minimal or no spillage. In this way, the treatment material is channeled into the retaining area 44 and not on the top surface 36 where, if it remained on the top surface 36, it may cause portions of the hair which are not to be treated, to receive some treatment material and reduce the separation of the hair into treatment and non-treatment portions.

After at least one of the retaining areas 44 has been charged with treatment material, the user scoops a desired, predetermined portion of hair using the point 29 of the handle 26. The user then places the comb 20 against the person's head so that the teeth 40 are touching the person's scalp. Since the retaining areas 44 do not extend beyond the length of the teeth 40, the treatment material does not substantially contact the scalp. This is important for most applications because the treatment material may be harmful, or at least irritable, to the scalp should it come in direct contact with the person's skin.

In a preferred method, the professional, or other user, holds the person's hair away from their head from about a 45 degree angle to about a 90 degree angle. Then, the comb is stroked through the hair at about a 90 degree angle to this portion of the hair. In an alternative method, the professional or other user strokes the comb through the selected portion of hair as it lies on the head. In this particular method, the comb is at about a 45 degree angle to the hair.

After placing the teeth 40 against the person's scalp, the user strokes the comb 20, in one steady stroke, through the portion of hair being treated and continues all the way to the end of the hair portion. As an alternative, the comb 20 may be used to re-touch the roots out to where the hair was previously treated and avoid re-treating or overlapping the previously treated hair. The user then repeats these same steps about three to about five times until the whole head of hair has been treated, and in this example, highlighted. The comb 20 is constructed in such a way that only between about three to about five applications are needed to finish a highlighting application. Also, the hair is weaved or separated out automatically by way of the construction of the tines 24. Both of these features provide a comb which is easier and quicker to use than those known in the prior art.

In alternate embodiments, the tines 24 may vary in length so as not to form an arcuate plane with a center of curvature. This embodiment may be used for those people who desire irregular highlights or coloring, as in this construction some of the roots of the person's hair may be treated while other roots may not.

In yet another embodiment, the tines may vary in width such that the hair being treated varies in relation to the amount of area being treated. In a more preferred embodiment, the tines may be adjustable to provide for various treatment effects.

Finally, the comb 20 may include more or less tines 24 or may have longer or shorter tines overall to accommodate certain particular needs of the person being treated.

Thus, there are many advantages of the present invention as described through the preferred embodiments discussed above. For instance, by being bowed and curved, the comb 20 is capable of treating hair close to the scalp. The word "close" as used herein includes distances from the scalp of about 1/32" to about 1/16". Furthermore, having forwardly deepening retaining areas 44 provides for consistent and continuous treatment of the hair, even if the person being treated has shoulder-length hair or longer. Finally, with recessed grooves 52 extending between the teeth 40 and channels 53 running in the bottom surface 38, the comb 20 is capable of being smoothly swiped through hair without snagging or jumping. This is particularly important for people with coarse hair. All of these features provide for a professional or desired appearance, even if a non-professional do-it-yourselfer is using the comb 20. In addition, a complete application may be performed in much less time than those processes, professionally or non-professionally, which now exist.

While the foregoing description of FIGS. illustrates preferred embodiments of the various techniques in accordance with the present invention, it should be appreciated that the invention also covers various embodiments which incorporate the inventive concepts underlying the foregoing described features, and that certain modifications may be made in the foregoing without departing from the spirit and scope of the present invention which is defined by the claims set forth immediately hereafter.

What is claimed is:

1. A highlighting comb, comprising:

a. a spine having a first end and a second end; and b. a plurality of spaced-apart tines arranged side-by-side between said first and second ends of said spine, each of said tines having a spine end attached to said spine and a forwardly extending free end remote from said spine, at least a portion of said tines having a top surface, a bottom surface, and side walls extending between said top and bottom surfaces, opposing side walls of adjacent tines being constructed to define a forwardly deepening retaining area in the space between said tines which extends lengthwise between said spine and free ends of said respective tines, said retaining area being adapted to retain hair treatment material at least partially by surface tension, and said retaining area being open adjacent said top and bottom surfaces of said tines so as to be adapted to receive hair for treatment and including a first retaining end and a second retaining end, and said opposing side walls of adjacent tines comprising opposing ledges extending therefrom to facilitate retention of hair treatment material within said retaining area, said ledges extending from said first end to said second end of said retaining area.

2. The highlighting comb of claim 1, wherein said retaining area extends from adjacent said spine end to adjacent said free end of said tines.

3. The highlighting comb of claim 1, wherein said first retaining end of said retaining area extends to said spine end of said tines and said second retaining end of said retaining area extends to said free end of said tines.

4. The highlighting comb of claim 1, further including a handle attached to said second end of said spine.

5. The highlighting comb of claim 4, wherein said handle converges to a point.

6. The highlighting comb of claim 1, wherein said tines vary in length, said tines being constructed such that said free ends of said tines form an arcuate plane.

7. The highlighting comb of claim 6, wherein said arcuate plane has a center of curvature, said arcuate plane being between said center of curvature and said free ends of said tines.

8. The highlighting comb of claim 1, wherein said spine bows from said first end to said second end of said spine.

9. The highlighting comb of claim 1, wherein said free ends of said tines further comprise a pair of spaced-apart teeth, said teeth defining a recessed groove therebetween, said recessed groove being adapted to receive hair not to be treated by the hair treatment material.

10. The highlighting comb of claim 9, wherein said bottom surface of said tines further defines a channel connected to said recessed groove for guiding hair not to be treated and at least partially received by said recessed groove along said bottom surface.

11. The highlighting comb of claim 1, further comprising flow barriers associated with said retaining areas for preventing the excess flow of hair treatment material toward said spine.

12. The highlighting comb of claim 1, further comprising indicia on said top surface for facilitating varying process steps.

13. A highlighting comb, comprising:

a. a spine having a first end and a second end;

b. a plurality of spaced-apart tines arranged side-by-side between said first and second ends of said spine, each of said tines having a spine end attached to said spine and a forwardly extending free end remote from said spine, each of said tines having a top surface, a bottom surface and side walls extending between said top and bottom surfaces, opposing side walls of adjacent tines being constructed to define a retaining area for retaining hair treatment material, said retaining area being defined in the space between said tines which extends lengthwise between said spine and said free ends of said respective tines, and said retaining area being open adjacent said top and bottom surfaces of said tines for receiving hair for treatment; and c. said spine being bowed from said first end to said second end of said spine to facilitate said comb to the contour of a person's head.

14. The highlighting comb of claim 13, wherein said tines vary in length and are constructed such that said free ends of said tines form an arcuate plane.

15. A highlighting comb, comprising:

a. a spine having a first end and a second end; and b. a plurality of spaced-apart tines arranged side-by-side between said first and second ends of said spine, each of said tines having a spine end attached to said spine and a forwardly extending free end remote from said spine, at least a portion of said tines having a top surface, a bottom surface, and side walls extending between said top and bottom surfaces, opposing side walls of adjacent tines being constructed to define a continuously forwardly deepening retaining area for retaining hair treatment, said retaining area being defined in the space between said tines which extends lengthwise between said spine and free ends of said respective tines, and said retaining area being open adjacent said top and bottom surfaces of said tines for receiving hair for treatment.

* * * * *